US005130206A

United States Patent [19]

Rajan et al.

[11] Patent Number: 5,130,206

[45] Date of Patent: Jul. 14, 1992

[54] SURFACE COATED RF CIRCUIT ELEMENT AND METHOD

[75] Inventors: Sunder S. Rajan, Anaheim Hills; Ivo Tammaru, Rancho Palos Verdes; Steve L. Bosma, Torrance; John W. Eldridge, Lakewood, all of Calif.

[73] Assignee: Hughes Aircraft Company, Los Angeles, Calif.

[21] Appl. No.: 736,844

[22] Filed: Jul. 29, 1991

[51] Int. Cl.[5] ..... G22F 3/00

[52] U.S. Cl. ..... 428/552; 419/9; 419/19; 419/36; 419/54; 419/57; 428/433; 428/553

[58] Field of Search ..... 428/552, 553, 433; 419/9, 19, 36, 54, 57

[56] References Cited

U.S. PATENT DOCUMENTS 4,052,530 10/1977 Fonzi ..... 428/552

4,594,294 6/1986 Eichen et al. ..... 428/552

*Primary Examiner*—Stephen J. Lechert, Jr.

*Attorney, Agent, or Firm*—Terje Gudmestad; W. K. Denson-Low

[57] ABSTRACT

Extra loss is introduced in coupled cavity and klystron RF circuits by applying a surface coating to selected parts of circuit elements used in the circuits. The coating is applied in the form of a slurry, which is then sintered. The slurry comprises a mixture of an iron-base powder (such as a stainless steel) and a dielectric glass ceramic, suspended in a binder dissolved in a solvent. Circuits with the loss coating are easier to match than by other prior art techniques. The loss coating of the invention reduces the fabrication cost of coupled-cavity traveling wave tubes, while improving the performance by minimizing the gain ripple. Higher average power operation is possible, due to elimination of loss buttons previously employed in the prior art.

22 Claims, 3 Drawing Sheets

SURFACE COATED RF CIRCUIT ELEMENT AND METHOD

BACKGROUND OF THE INVENTION

1. Field of the Invention

The present invention relates to high power microwave tubes, and, more particularly, to a method for fabricating a coating on circuit parts employed in such microwave tubes that introduces controlled RF losses in the circuit.

2. Description of Related Art

Extra loss is introduced in RF circuits of most coupled-cavity traveling-wave tubes (TWTs) for stability or for reduced gain variations with frequency. Loss is also introduced in selected cavities of klystron circuits for control of bandwidth and gain flatness.

Presently, loss is typically introduced in coupled-cavity RF circuits by means of lossy ceramic elements (called "loss buttons") or by coating cavity surfaces with KANTHAL® heating element alloy by flame spraying. (KANTHAL is a trademark of Kanthal Corp., Bethel, Conn.; the alloy is an iron-chromium-aluminum alloy.)

Loss buttons suffer from a variety of ills in different applications, such as (a) high material cost, particularly at lower frequencies (S and C band); (b) labor intensiveness, with buttons requiring individual tuning and/or a substantial effort in circuit matching; (c) limited power handling capacity, giving rise to power fade with increasing duty or suffering overheating and cracking; and (d) lot-to-lot variability in RF characteristics.

Applying KANTHAL alloy by flame spraying is a process that is difficult to control for consistency. The process is also not practical at mm wave frequencies, due to the use of thin and fragile circuit parts at such frequencies, with tight tolerances on dimensions; the process creates a coating that is too thick and coarse to maintain sufficient precision on the critical dimensions of the structure, and it may result in distortion of the parts.

Accordingly, it is desired to introduce loss in RF circuits by a reliable and reproducible method.

SUMMARY OF THE INVENTION

In accordance with the invention, extra loss is introduced in coupled-cavity and klystron RF circuits by means of a surface coating comprising particles of an iron-base alloy dispersed in a glass ceramic matrix. Circuit parts are coated with a slurry, which is subsequently sintered. The slurry comprises a mixture of the iron-base powder and the glass ceramic, suspended in a binder.

The technique for producing an RF loss coating on circuit parts for high power microwave tubes produces reproducible coatings with good loss properties as well as good adhesion on both copper and iron parts. The surface coating can eliminate the need for loss buttons in coupled-cavity circuits, both reentrant buttons that are difficult to match and resonant buttons that must be individually tuned. The surface coating also provides an amount of loss that is greater than can be obtained with KANTHAL alloy.

Advantageously, circuits with loss coatings are generally easy to match. The loss coating of the invention reduces the fabrication cost of coupled-cavity TWTs, while improving the performance by minimizing the gain ripple. By eliminating the power-limiting loss buttons, the loss coating can also allow higher average power operation.

DESCRIPTION OF THE PREFERRED EMBODIMENTS

Figure 1:
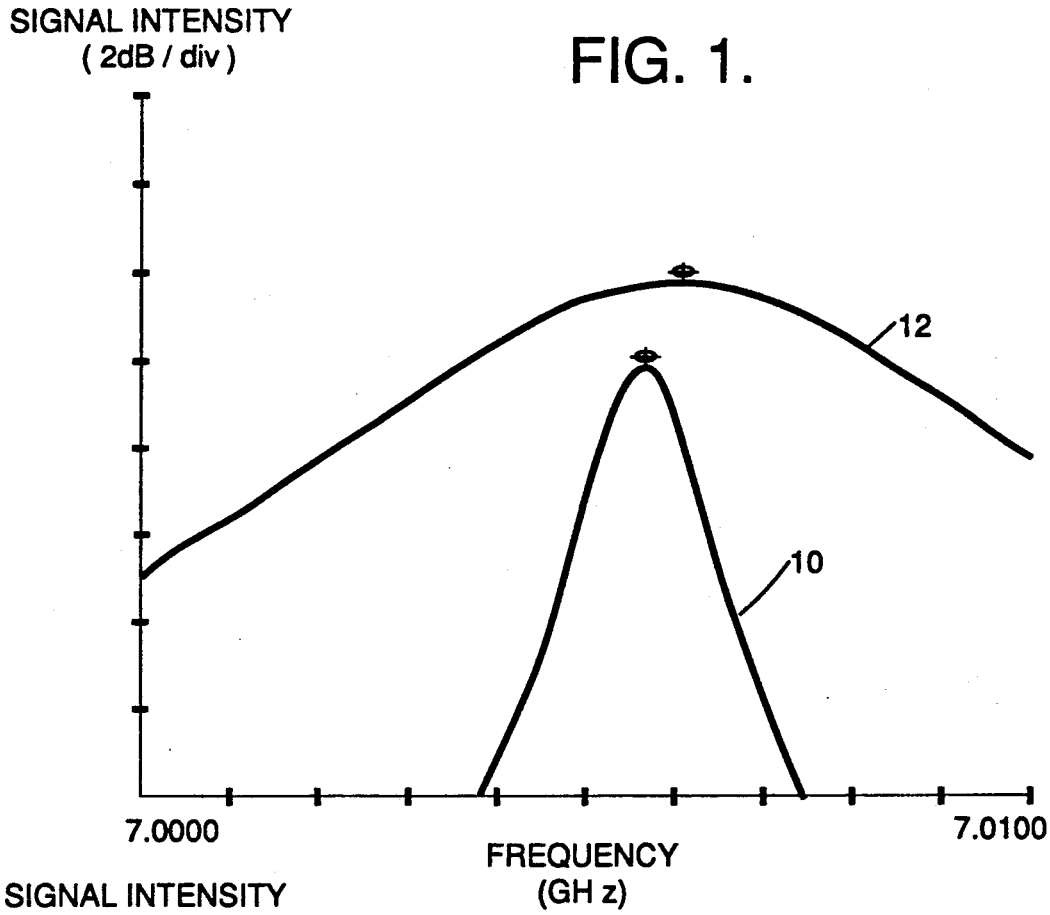
FIG. 1, on coordinates of signal intensity (in dB) and frequency (in GHz), shows the resonant response of cylindrical test cavities of copper and iron, prior to applying the coating of the invention, with the width of the resonance being a measure of the cavity loss.

The main objective is to apply a coating to RF circuit parts in devices such as TWTs for the purpose of providing RF circuit loss. The coating must have good adhesion. Another objective is to be able to apply the coating selectively to well-defined surface regions for maximum control of the pattern of RF loss with frequency.

The purity of all materials employed herein is that found in normal commercial practice. Amounts herein are in terms of percent by weight, unless otherwise indicated.

The loss coating formulation and its application are the key unique features of this invention. The coating comprises an iron-base alloy, preferably alloyed with nickel and chromium. Such an alloy coating, which is formed on an oxidized surface, must be compatible with the underlying metal, and should have an effective surface resistivity which is substantially higher than that of the typically-used bare metals like copper or iron.

For operation of high power coupled-cavity circuits at S band, the effective surface resistivity should be greater than about one ohm, or about two orders of magnitude higher than that of copper (whose surface resistivity is 0.014 ohms at 3 GHz). At higher frequencies, because of lower RF power levels and less beam power, less loss is generally required, although the amount of loss also depends on other circuit characteristics like bandwidth. For a device with very large bandwidth at mm wavelengths, such as 20% at 90 GHz, an effective surface resistivity of approximately one ohm would again be required; in this case, the effective resistivity is only one order of magnitude higher than that of copper (whose surface resistivity, being proportional to the square root of the frequency, is 0.08 ohm at 90 GHz).

An especially preferred alloy useful in the practice of the invention is pre-alloyed iron-nickel-chromium-molybdenum having the following composition:

about 67 to 72% iron, about 16 to 18% chromium,
about 10 to 14% nickel, and
about 2 to 3% molybdenum.

The alloy may have less than about 1% each of manganese and silicon. Trace quantities of carbon, sulfur, and phosphorus may be present without adversely affecting the properties of the alloy. Such an alloy is commercially available as 316 stainless steel powder.

The alloy is applied to the surface of the circuit element as a powder (described herein as a "dispersion") in a matrix of a dielectric glass ceramic (described herein as a "medium"). The composition of the glass ceramic is chosen to approximately match the thermal coefficient of expansion of the metal substrate (within about 10%). The glass ceramic must adhere to the metal substrate; specifically, the adherence must pass Fed. Spec. PPP-T-42C. A particularly preferred glass ceramic is an alkali silicate containing a substantial amount of alumina and minor amounts of magnesia and calcia, having the following composition:

about 60 to 65% silica,
about 15 to 20% alumina, and
about 10 to 15% soda ash and carbonates.

The glass ceramic also contains about 1% each of magnesia, calcia, and lithia. Such a glass ceramic is commercially available as Gingival White Porcelain Optec from Jeneric/Pentron, Inc.

The ceramic and metallic powders are mixed in a ratio ranging from about 9 parts by weight of alloy to 1 part by weight of ceramic (9:1) to about 1 part by weight of alloy to 3 parts by weight of ceramic (1:3). That is, approximately 10 to 75% of the mixture is the glass ceramic. Mixing is done by conventional ball milling or other well-known mechanical methods. A powder having an average particle size of about 2 to 10 $\mu$m is desirably employed in the practice of the invention.

This mixture of ceramic and metallic powders is then made into a slurry using a carrier comprising a binder in a solvent. The slurry, after drying, is then sintered to form a sort of glaze of the medium in which the alloy is dispersed.

The ceramic/alloy mixture is made into the slurry with the addition of a polymer in solution. The slurry is one that provides sufficient viscosity to the applied coating. A sufficient viscosity is one that will hold the medium and the dispersion in suspension without settling (minimal segregation or stratification effects). If the viscosity is too thin, then the slurry runs off the surface; if the viscosity is too thick, then a uniform coating is not obtained. For example, if the coating is brushed on, the viscosity ranges from about 35,000 to 60,000 cp, while if the coating is sprayed on, the viscosity desirably ranges from about 65,000 to 90,000 cp.

The polymer is one that burns off without leaving any residues. Examples include methyl methacrylate, methyl cellulose, and polyvinyl alcohol.

The solvent used to dissolve the polymer must mix well (not allow segregation or stratification) and burn off completely. Suitable solvents include the acetates, such as amyl acetate, ketones, such as methyl ethyl ketone, and terpineol.

The amount of polymer in solvent ranges from about 10 to 40% of the total solution concentration. An example of a suitable combination is a solution of 15% methyl methacrylate in amyl acetate.

The amount of the polymer solution used to make the slurry with the powder mixture should be kept as low as possible, in order to provide uniformity in thickness of the final coating. If too much solution is employed, blistering of the coating can develop during sintering. As an example, a suitable combination is 10 ml of a solution of 15% methyl methacrylate in amyl acetate to 10 g of powder mixture.

As used herein, uniform coating refers to a coating in which there are no bare spots of the substrate visible after sintering. For example, for a coating on the order of about 1 to 2 mils thick after sintering, the variation in coating thickness may be about $\pm 0.2$ mils.

Solvent can be added as necessary to adjust the viscosity, in accordance with the considerations discussed above.

The slurry is then milled thoroughly until a homogeneous mix of the materials is obtained. For example, 48 to 72 hours has been found to be sufficient when using the preferred compositions described above.

The metal surface to be coated is first thoroughly cleaned to be free of oil, grease, or any other (lubricant) film residue, by degreasing and then by detergent washing. The surfaces may be acid-etched and grit-blasted, if necessary, to provide for improved adherence of the coating thereto. Such cleaning procedures are well-known and do not form a part of this invention. Depending on the thickness of the coating or the nature of the application, etching and grit-blasting may or may not be found necessary.

Next, the metal surfaces are oxidized to obtain a uniform, thin surface oxide layer. The oxide coating must be thick enough to avoid pinhole formation, but not so thick as to create stresses or to form flakes or to otherwise crack during application of the coating or use thereof. Desirably, the oxide coating is on the order of a maximum of a few hundred microinches.

Oxidation may be performed by any of the well-known techniques, such as thermal or chemical; the particular method used forms no part of this invention. For example, heating and soaking the parts in an air oven typically at about 200° to 500° C. for about 10 minutes to 2 hours (the shorter times being associated with the higher temperatures) is sufficient to oxidize pure copper and iron parts.

The coating can be applied to the metal surface by brush painting or spraying. The viscosity of the mix can be adjusted as needed by thinning with a solvent, as described above.

The green coating may be applied in approximately the same thickness as the desired thickness after sintering, it having been found that there is little loss in thickness during processing.

The coated parts are first dried in an oven to remove moisture and low temperature volatiles and thereby avoid blister formation in the coating. The drying may be done at any temperature above room temperature up to about 100° C. for at least a few minutes. As an example, drying is done at about 65° to 75° C. for about 10 to 15 minutes. Any coating anomalies are corrected by touch-up, and if necessary, the coating can be removed and reapplied.

The dried, coated parts are then sintered in a non-oxidizing atmosphere at a temperature ranging from about 850° to 1,000° C. for about 15 minutes to 1 hour, the shorter times being associated with the higher temperatures. If the temperature is too high, it has a tendency to degrade the ceramic. If the temperature is too low, the coating will not form the desired glaze and could also be adversely affected by subsequent processing temperatures of the circuit elements, which temperatures can approach 800° C.

Examples of suitable atmospheres include wet hydrogen, dry hydrogen, vacuum, and inert gases, such as argon, helium, and the like. As an example, sintering may be done in a wet hydrogen atmosphere at about 950° to 980° C. for about 15 to 20 minutes.

The sintering process adheres the coating to the substrate. The sintering process is totally compatible with the furnace atmospheres and schedules used in vacuum assembly processing. The coated substrate is capable of withstanding processing such as brazing, thermal cycling, and thermal shock.

Coating thicknesses typically range from about 0.001 to 0.003 inch. For high frequency applications involving millimeter waves, such thick coatings may not be desirable. Coatings are made thinner (less than 0.001 inch) and more uniform by modifying the surface preparation and by refining the slurry. In such cases, the surface is not roughened, and indeed, surface roughness is minimized, using any of the well-known procedures for providing a comparatively smooth surface. Also, the slurry is refined by making the average particle size of the powder mixture small and uniform.

It has been demonstrated that the coating can be selectively applied in a controlled manner to areas where it is most effective. This is a significant advantage to plasma spraying and other techniques involving excess and over-sprays which require masking and subsequent machining. Coatings can be selectively applied to particular inside surfaces, as desired. For example, the inside surface of cylindrical parts may be coated by the process of the invention.

Figure 2:
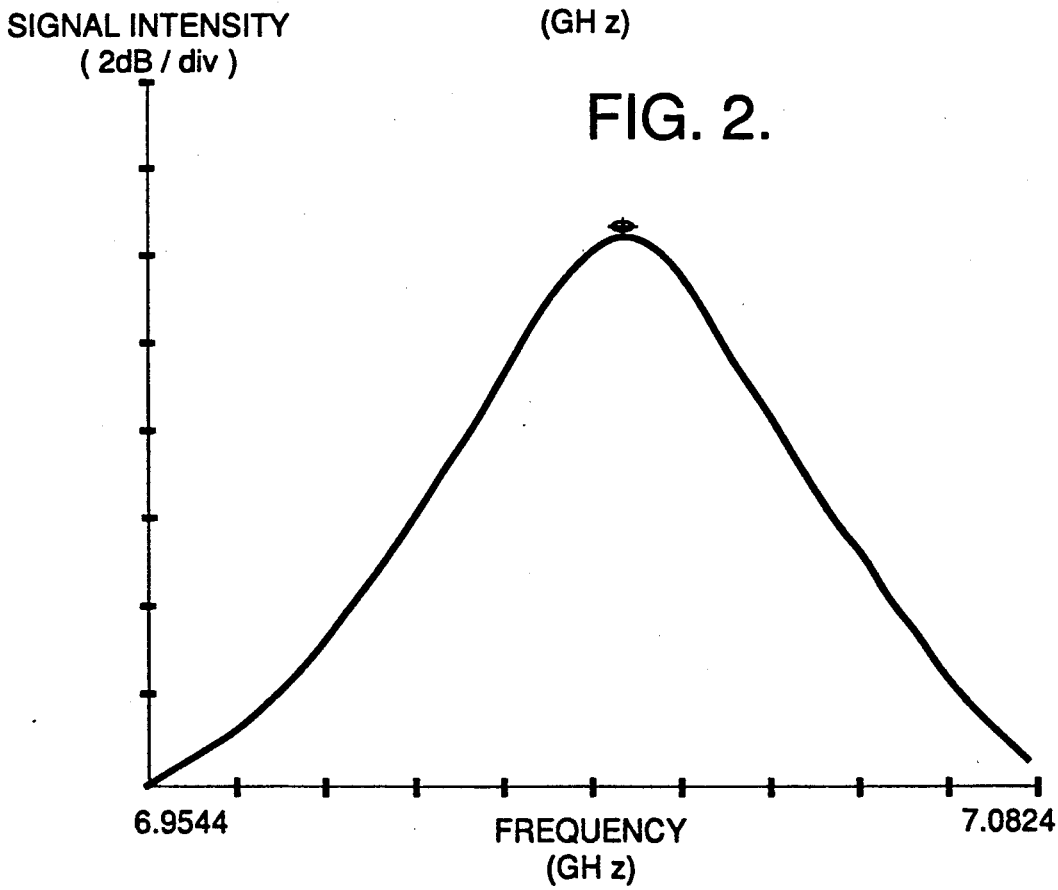
FIG. 2, on coordinates of signal intensity (in dB) and frequency (in GHz), shows the resonant response of a cylindrical test cavity of copper, subsequent to applying the coating of the invention.
Figure 3:
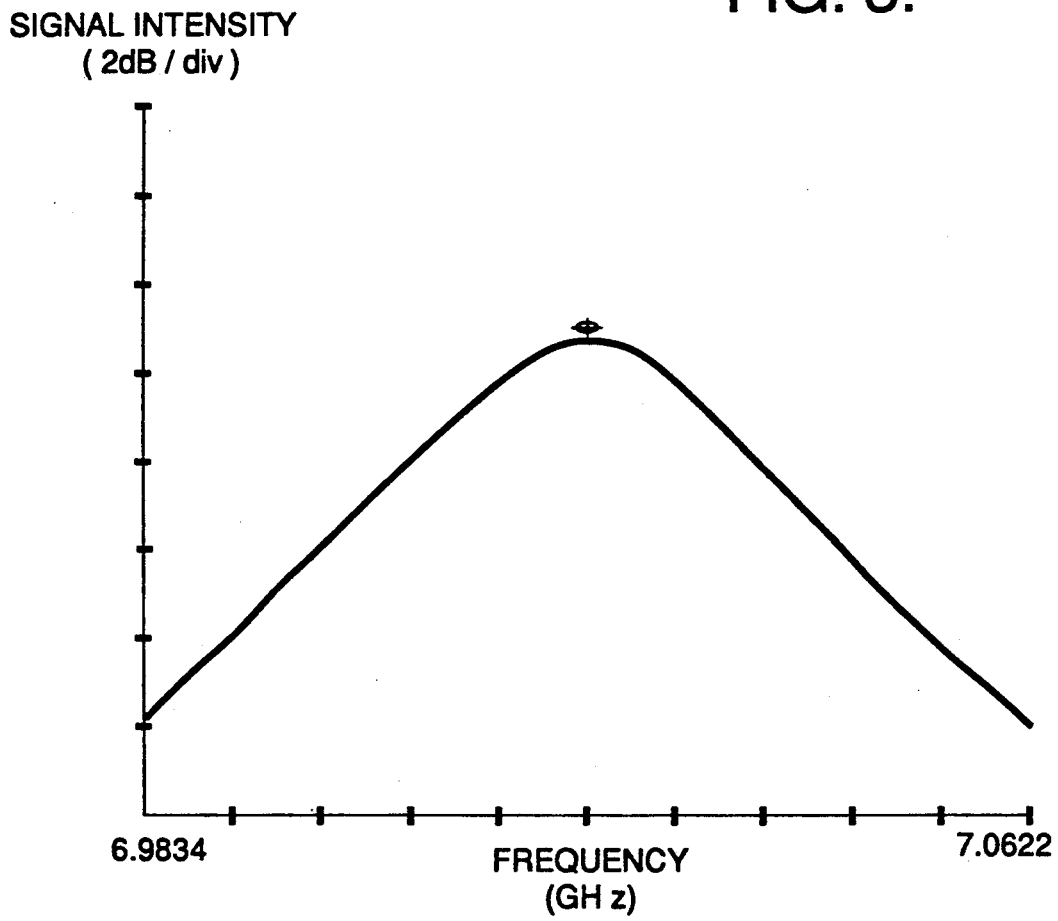
FIG. 3, on coordinates of signal intensity (in dB) and frequency (in GHz), shows the resonant response of a cylindrical test cavity of iron, subsequent to applying the coating of the invention.

The data obtained by loss measurements on cylindrical test cavities of copper and iron are shown in FIGS. 1-3. The test cylinder dimensions were 1.148±0.001 inch O.D., 0.980±0.001 inch I.D., and 0.800±0.001 inch height. The cylindrical cavity parts were inserted between plates with hollow ferrules protruding into the cavity, in a configuration similar to that used in RF cavities in klystrons and coupled-cavity traveling-wave tubes. The main effect of the ferrules was to lower the cavity resonant frequency from about 9.2 GHz to approximately 7.0 GHz.

The cylinders when tested prior to coating exhibited Q values of 5,390 for copper (Curve 10 in FIG. 1) and 1,110 for iron (Curve 12). After coating, the copper and iron cylinders each exhibited Q values of approximately 210, as shown in FIGS. 2 and 3, respectively. The Q of cavities with KANTHAL ® alloy was higher by more than 50%, which proves the superiority of the new coating.

Figure 4:
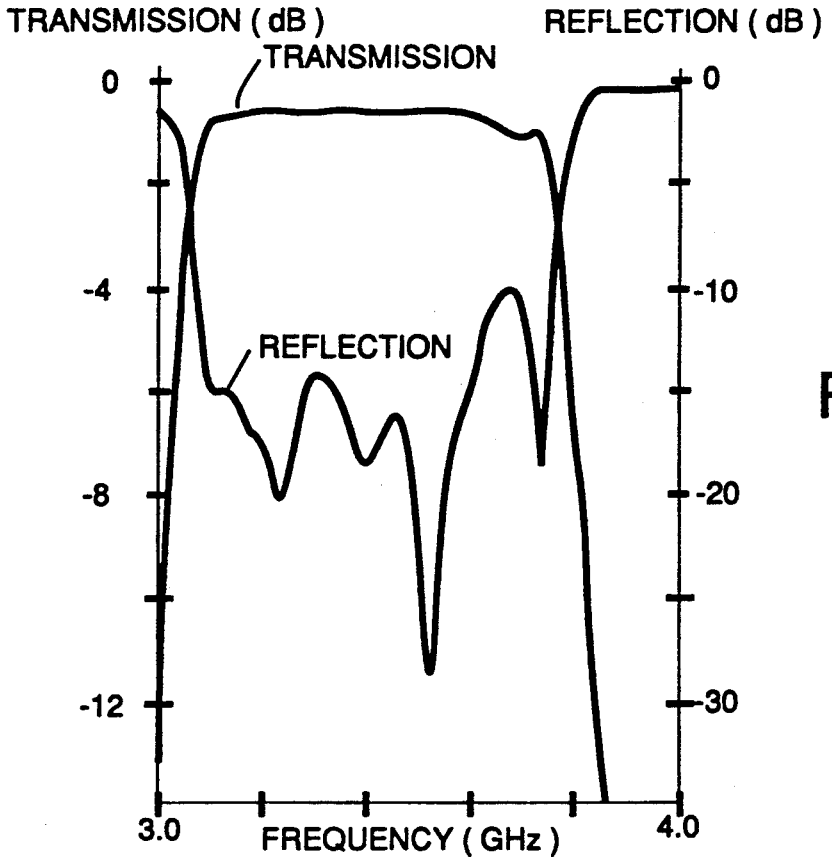
FIG. 4, on coordinates of signal intensity (in dB) and frequency (in GHz), depicts the RF transmission and reflection in an S-band coupled-cavity circuit with no loss coating.
Figure 5:
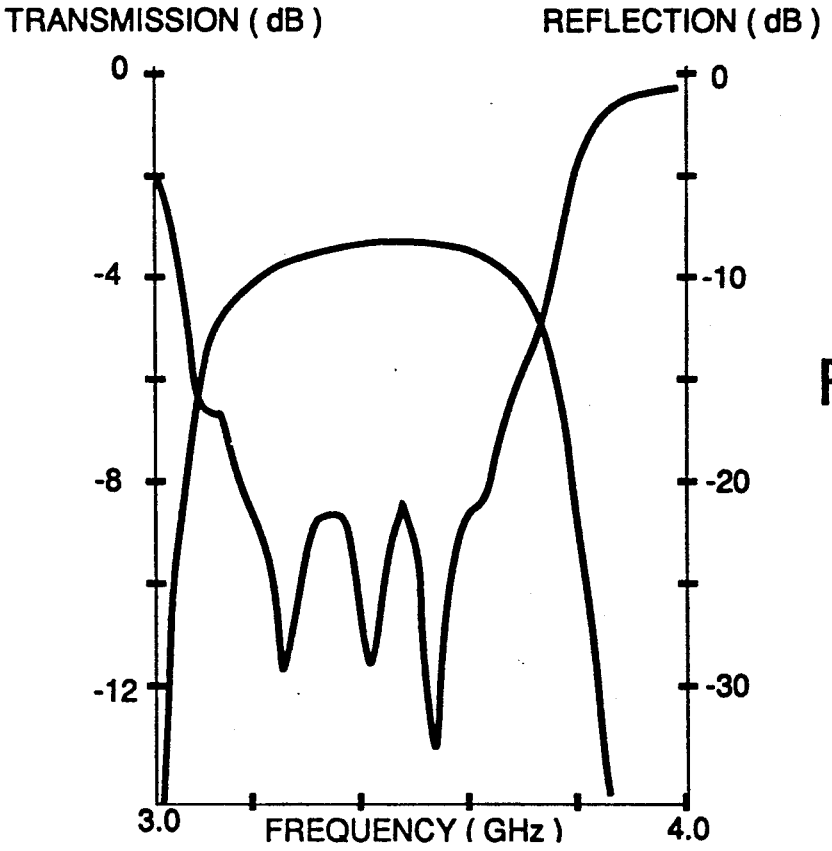
FIG. 5, on coordinates of signal intensity (in dB) and frequency (in GHz), depicts the RF transmission and reflection in an S-band coupled-cavity circuit with the loss coating of the invention.

The change in RF transmission and reflection in an S-band coupled-cavity circuit section having five cavities is seen by comparing FIG. 4 (no loss coating) with FIG. 5 (loss coating). In the middle of the passband, at approximately 3.4 GHz, the coating increases the transmission loss from 0.55 dB to 3.25 dB, or by more than 0.5 dB/cavity. While increasing the transmission loss, the coating also improves the circuit match (reduces the reflected power).

The loss coating of the invention therefore facilitates circuit matching, in contrast to loss buttons which make matching more difficult.

To check the adhesion and integrity of the coating, a tape with film adhesive was pressed against the coated surface, pulled away, and examined under a microscope. No traces of coating material were found on the tape. It should be noted that the tape test (Fed. Spec., supra) is actually quite severe; some metal coating deposits used in TWT production processes will not pass this test.

The loss coating technique of the invention can potentially replace all or most buttons in practically all coupled-cavity TWTs, for reduced cost and better performance. It facilitates the design and manufacture of wideband coupled-cavity TWTs by allowing a simple and effective method for selectively enhancing the loss at the low frequency end of the passband (by coating the interior surfaces of the coupling slots, as in U.S. Pat. No. 3,453,491). It also opens up the possibility of introducing loss in mm wave circuits, with the potential of substantially widening the performance band of mm wave coupled-cavity TWTs.

Thus, there has been provided a loss coating process which provides a coating with good RF loss, has good adhesion, can be applied selectively in a controlled manner, facilitates circuit matching, and which can result in improved performance of TWTs and other microwave tubes. Many changes and modifications of an obvious nature will be readily apparent to those of ordinary skill in the art, and all such changes and modifications are considered to fall within the scope of the invention, as defined by the appended claims.

What is claimed is:

1. A method for introducing controlled loss in RF structures comprising the steps of:
   (a) coating selected portions of said structure with a slurry comprising a mixture of an iron-base alloy powder and a glass ceramic; and
   (b) sintering said slurry.

2. The method of claim 1, wherein said coating comprises an iron base alloy including nickel and chromium powder dispersion in a matrix of a dielectric glass ceramic, made into said slurry by adding a binder in a solvent.

3. The method of claim 2 wherein said dispersion comprises a pre-alloyed iron-nickel-chromium-molybdenum powder.

4. The method of claim 3 wherein said dispersion consists essentially of:
   about 67 to 72% iron,
   about 16 to 18% chromium,
   about 10 to 14% nickel, and
   about 2 to 3% molybdenum.

5. The method of claim 2 wherein said matrix consists essentially of:
   about 60 to 65% silica,
   about 15 to 20% alumina, and
   about 10 to 15% soda ash and carbonates.

6. The method of claim 2 wherein the ratio of said dispersion to said matrix ranges from about 9:1 to 1:3.

7. The method of claim 2 wherein said binder consists essentially of a polymer which burns off completely during sintering, said binder mixed with said dispersion and said medium with sufficient solvent to provide a viscosity suitable for applying said slurry to said structure.

8. The method of claim 7 wherein said polymer is selected from the group consisting of methyl methacrylate, methyl cellulose, and polyvinyl alcohol.

9. The method of claim 1 wherein a substantially uniform, thin surface oxide layer is formed on a cleaned metal surface of said circuit prior to applying said coating.

10. The method of claim 9 wherein said oxide coating is substantially free of pinholes and is no more that about a few hundred microinches in thickness.

11. The method of claim 1 wherein said coated parts are first dried at a temperature ranging from above room temperature to about 100° C. prior to said sintering.

12. The method of claim 1 wherein said coated parts are sintered at a temperature of about 850° to 1,000° C. in a non-oxidizing atmosphere for about 15 minutes to 1 hour.

13. A coated RF circuit element having controlled RF loss, said loss provided by a coating on a surface of said element comprising an iron-base alloy dispersion in a glass ceramic matrix.

14. The coated circuit element of claim 13, wherein said coating comprises an iron base alloy including nickel and chromium dispersion in a matrix of a dielectric glass ceramic.

15. The coated circuit element of claim 14 wherein said dispersion comprises a iron-nickel-chromium-molybdenum alloy.

16. The coated circuit element of claim 15 wherein said dispersion consists essentially of:

about 67 to 72% iron,
about 16 to 18% chromium,
about 10 to 14% nickel, and
about 2 to 3% molybdenum.

17. The coated circuit element of claim 14 wherein said matrix consists essentially of:

about 60 to 65% silica,
about 15 to 20% alumina, and
about 10 to 15% soda ash and carbonates.

18. The coated circuit element of claim 14 wherein the ratio of said dispersion to said matrix ranges from about 9:1 to 1:3.

19. The coated circuit element of claim 13 further including a substantially uniform, thin surface oxide layer interposed between a surface of said circuit element and said coating.

20. The coated circuit element of claim 19 wherein said oxide coating is substantially free of pinholes and is no more that about a few hundred microinches in thickness.

21. The coated circuit element of claim 13 wherein said circuit element comprises a metal selected from the group consisting of iron and copper.

22. The coated circuit element of claim 13 wherein said coating ranges up to about 3 mils in thickness.

* * * * *